US012480397B1

(12) United States Patent
Hoelscher et al.

(10) Patent No.: US 12,480,397 B1
(45) Date of Patent: Nov. 25, 2025

(54) SENSOR PERFORATOR MONITORING

(71) Applicant: Halliburton Energy Services, Inc., Houston, TX (US)

(72) Inventors: Christopher C. Hoelscher, Alvarado, TX (US); Nicholas Cole Ashford, Carrollton, TX (US); Eric Michael Conzemius, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/882,281

(22) Filed: Sep. 11, 2024

(51) Int. Cl.

| | |
|---|---|
| ***E21B 47/017*** | (2012.01) |
| ***E21B 43/116*** | (2006.01) |
| ***E21B 47/06*** | (2012.01) |
| ***E21B 47/12*** | (2012.01) |

(52) U.S. Cl.
CPC ..... *E21B 47/017* (2020.05); *E21B 43/116* (2013.01); *E21B 47/06* (2013.01); *E21B 47/12* (2013.01)

(58) Field of Classification Search
CPC ..... E21B 43/119; E21B 47/017; E21B 47/06; E21B 47/12; E21B 43/116
See application file for complete search history.

(56) References Cited

U.S. PATENT DOCUMENTS

| | | | | |
|---|---|---|---|---|
| 10,947,837 | B2 | 3/2021 | Jarvis et al. | |
| 11,092,000 | B2 | 8/2021 | Jarvis et al. | |
| 11,111,777 | B2 | 9/2021 | Jarvis et al. | |
| 11,286,769 | B2 | 3/2022 | Jarvis et al. | |
| 11,661,824 | B2 * | 5/2023 | Eitschberger | E21B 33/068 175/4.55 |
| 2009/0151589 | A1 * | 6/2009 | Henderson | F42D 3/04 102/333 |
| 2014/0260591 | A1 * | 9/2014 | Rodgers | E21B 43/1195 73/152.58 |
| 2016/0293294 | A1 * | 10/2016 | Matlack | H01B 7/421 |
| 2017/0268326 | A1 * | 9/2017 | Tao | E21B 47/017 |
| 2022/0412904 | A1 | 12/2022 | Suard et al. | |

* cited by examiner

*Primary Examiner* — Brad Harcourt
(74) *Attorney, Agent, or Firm* — DeLizio, Peacock, Lewin & Guerra LLP

(57) ABSTRACT

A perforating system comprising a first carrier. The perforating system comprises a first charge holding tube configured with one or more shaped charges, wherein the first charge holding tube is positioned within the first carrier. The perforating system comprises one or more sensors positioned within the first carrier and configured to obtain one or more measurements of a perforated zone in a wellbore.

18 Claims, 8 Drawing Sheets

SENSOR PERFORATOR MONITORING

TECHNICAL FIELD

The disclosure generally relates to the field of perforating a wellbore in a subsurface formation and more particularly to perforation monitoring.

BACKGROUND

In hydrocarbon recovery operations, a perforating gun may be positioned in a wellbore to perforate the casing such that the wellbore may hydraulically communicate with the surrounding formation. Shaped charges positioned in the perforating gun may explode to create perforations in the surrounding casing and formation, allowing for formation fluid to enter the wellbore and/or hydraulic fracturing operations to be performed on the formation.

BRIEF DESCRIPTION OF THE DRAWINGS

Implementations of the disclosure may be better understood by referencing the accompanying drawings.

DESCRIPTION

Figure 1:
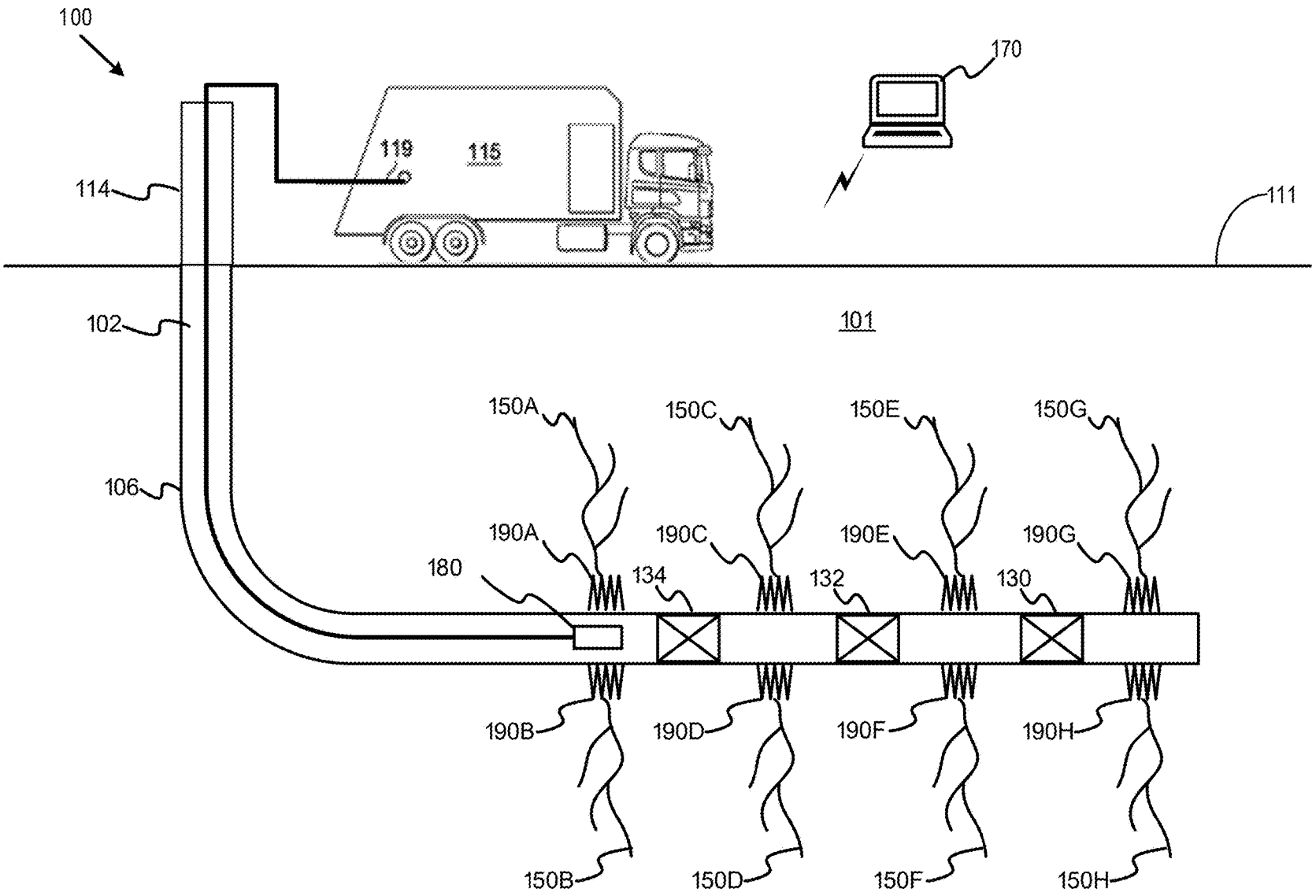
FIG. 1 is an illustration depicting an example well system, according to some implementations.

The description that follows includes example systems, methods, techniques, and program flows that embody aspects of the disclosure. However, it is understood that this disclosure may be practiced without these specific details. For instance, this disclosure refers to one or more sensors positioned within a charge holding tube. Aspects of this disclosure can also be applied to any other perforation system configurations where the sensors may be positioned on any suitable point within the perforating system. For clarity, some well-known instruction instances, protocols, structures, and operations have been omitted.

Example implementations relate to a perforating system for perforating a wellbore formed in a subsurface formation. During the completion process of a wellbore, a perforating system of one or more perforating guns may be positioned in a wellbore to perforate sections of the casing such that the respective sections may be hydraulically fractured. The perforating system may include one or more carriers. Within each carrier may be one or more charge holding tubes holding shaped charges. A detonating cord may be coupled to each shaped charge such that each shaped charge may detonate at a desired location in the wellbore when a signal is communicated to a detonator coupled with the detonating cord. When a shaped charge is detonated, a hole may be formed in the casing (and cement and surrounding formation) of the wellbore, allowing hydraulic communication between the wellbore and the surrounding formation. Properties, such as temperature, pressure, etc., of the wellbore before and/or after a zone is perforated may be utilized in monitoring and evaluating the perforated zone of a wellbore. For example, a hydraulic fracturing plan for a stage of a wellbore may be generated, altered, etc. based on the pressure and/or temperature of the wellbore corresponding to the perforated zone. Conventional approaches may measure said properties by removing the perforating system from the wellbore and tripping in a different system (tool) configured with sensors to obtain the measurements, resulting in additional time and/or costs. In some implementations, conventional approaches may attach sensors to external components of the perforating system (such as the carrier). This may expose the sensors to the risk of being damaged when running in hole and reduce the annular area between the perforating system. Additionally, the sensors may need to be manually attached to the carriers (such as with banding) which may lead to additional non-productive time and costs during well completion and stimulation operations (such as hydraulic fracturing operations). In contrast with conventional approaches where multiple trips may be required to obtain wellbore property measurements, example implementations may integrate one or more sensors into the perforating system to obtain real time measurements of the perforated zone of the wellbore. The perforating system with integrated sensors may allow for a single trip system to perforate and obtain measurements of a perforated zone. Thus, real time measurements of the perforated zone may be obtained. Additionally, with the sensors internally positioned in the perforating system, the risk of damaging the sensors and associated components when transporting the perforating system in and out of the wellbore may be reduced.

In some implementations, one or more sensors and the associated communication and power conduits, cables, wiring, etc. may be positioned within a perforating system. The perforating system may be deployed into a wellbore via any suitable technique such as wireline, tubing conveyed perforating (TCP), etc. A perforating system may include one or more charge holding tubes, with shaped charges, positioned in a carrier. One or more sensors may be positioned within the carrier. For example, one or more sensors may be positioned in the inner bore of a charge holding tube, integrated into the charge holding tube (such as within a hole of the charge holding tube in place of a shaped charge), positioned between the charge holding tube and the carrier, etc. The sensors may be configured to communicate data (such as pressure measurements, temperature measurements, etc.) to the surface via one or more communication components in real time. For example, the sensors may measure pressure, temperature, fluid properties, fluid composition etc. of the wellbore and/or fluid present in the wellbore before and/or after perforating the casing of a wellbore. In some implementations, the measurements may be processed downhole (i.e., the perforating system may include components configured to process the measurements and subsequently communicating the processed measurements to the surface). For example, the perforating system may process measurements to determine the fluid composition of the fluid at a depth interval, and then communicating the fluid compositions to the surface. The measurements may be communicated via wireline to the surface, a wireless communication device, etc. For example, a wireless telemetry system may be utilized to communicate the measurements to the surface. In some implementations, the sensors may be configured with a memory device to store measurements, that may then be obtained when the sensors are returned to the surface. In some implementations, the sensors may be positioned in respective sensor enclosures to provide containment, protection, and connectivity of the sensor.

In some implementations, a communication conduit may be coupled with and/or positioned within at least a portion of a charge holding tube. For example, the communication conduit may be positioned in the inner bore of the charge holding tube, on the outside of the charge holding tube, on the inner bore wall of the carrier, etc. A sensor node comprising one or more sensors and any associated components (such as a battery) may be coupled with the communication conduit. Any suitable wires, cables, etc. may be positioned in the communication conduit to electrically couple sensors to communication device(s), power source(s), etc. such that power and/or data may be communicated to and from the sensors. For example, the communication conduit may include an electrical conductor (such as a flexible solid cylinder encased in an insulating jacket). In some implementations the communication conduit may be at least partially encased with a protective shield configured to protect the communication conduit from the shaped charges when detonated. The shield may be any suitable shock-absorbing material to provide a barrier to shrapnel from the other internal components of the perforating system. It may be beneficial to utilize materials that may provide adsorption of energy/moment transfer be deformation, such as composites and/or alloys of aluminum, chromium, nickel, copper, lead, silver, gold, tin, etc. The shape of the shield may be curved, cylindrical, gnomon shaped, etc. such that the shield may protect the communication conduit. In some implementations, the shield may be of a layered design or one or more materials.

In some implementations, perforating systems may be modular in structure such that connectors (such as connecting bulkheads, threaded connections, etc., where the connectors may or may not seal) may be positioned to connect one carrier to other carriers with minimal spacing between shaped charge loaded lengths. The connectors may be configured to provide sensors and connections to mating communication conduits of each perforating system. For example, a perforating system may include two carriers. A first carrier may include one or more sensors positioned in a charge holding tube. A communication conduit may also be positioned in the charge holding tube and coupled with the sensors. A second carrier may include one or more sensors positioned in a charge holding tube. A communication conduit may also be positioned in the charge holding tube and coupled with the sensors. The carriers may be coupled together via a connecting bulkhead. The communication conduits in each carrier may be communicatively coupled to each other via the connector.

The sensors may be positioned in the carrier of the perforating system prior to the perforating system being tripped in the wellbore. For example, the sensors may be installed in a service center, manufacturing facility, etc. In some implementations, sensor enclosures may be positioned in the carrier (such as in the charge holding tube). The sub-assembly of the charge holding tube (with shaped charges) and sensor enclosure(s) may be installed into the carrier. The sensors may be positioned in the respective sensor enclosures before or after the charge holding tube is installed in the carrier. For example, the sensors may be positioned in the sensor enclosures, via ports in the carrier (if present), after the charge holding tube and sensor enclosure sub-assembly is installed in the carrier. The sensor enclosure may be configured to provide the sensor with protection from the wellbore conditions (if needed), explosive energy from the shaped charges, etc. The sensor enclosure and respective sensors may be positioned at any suitable position in the carrier. For example, the sensor enclosures may be positioned proximate the distal ends of the carrier (such as the first and last positions within the charge holding tube). This may provide data nodes that are positioned at the perforating interval length top and bottom. Positioning the sensor enclosures/sensors near the ends of the perforation system may provide additional protection from the explosive detonation shocks within the carrier. The sensors may be positioned inside the carrier such that it passes through the gun carrier wall allowing it to be exposed to the wellbore. The sensor may be inserted and retained in the carrier wall by a thread adapter or separate retaining device. The retaining device may provide a sealed port to prevent wellbore fluid from entering the carrier

Example System

FIG. 1 is an illustration depicting an example well system, according to some implementations. In particular, FIG. 1 is a schematic of a well system 100 that includes a wellbore 102 in a subsurface formation 101. The wellbore 102 includes casing and a number of perforations 190A-190H being made in the casing 106 at different depths to allow reservoir fluids (i.e., oil, water, and gas) from the subsurface formation 101 to flow into the wellbore 102. During hydraulic fracturing operations of the wellbores 102, fracturing fluid, with or without sand, may be pumped into the subsurface formation 101, via the perforations 190A-190H, to generate fractures 150A-150H in the subsurface formation such that reservoir fluid may flow into the wellbore 102.

The perforations 190A-190H may be formed via a perforating gun 180. Shaped charges in the perforating gun 180 may be detonated to create the perforations 190A-190H. The perorating gun 180 may be deployed into the wellbore 102 on a wireline 119 via a wireline truck 115. In some implementations, the perforating gun 180 may be deployed via other methods such as coiled tubing, jointed tubing, etc. In some implementations, the perforating gun 180 may include one or more sensors to obtain measurements (such as pressure, temperature, etc.) of the wellbore before and/or after the perforations 190A-190H are formed. The sensors may be positioned within the perforating gun 180, such as coupled within the charge holding tube within a carrier of the perforating gun. The perorating gun 180 may transmit these different measurements to the surface via the wireline 119 (or other suitable communication techniques) for further data processing.

The wireline truck 115 can include a computer 170 and other devices to monitor data perforating operations by the perforating gun 180. In some implementations, the computer 170 can be local or remote to the wellsite. A processor of the computer 170 may perform operations, such as obtaining wellbore measurements via the one or more sensors on the perforating gun. In some implementations, the processor of the computer 170 can receive and store measurement data from the sensors in the perforating gun 180 and/or control and perforating gun 180 operations, such as detonating the shaped charges. An example of the computer 170 is depicted in FIG. 5, which is further described below.

In some implementations, the wellbore 102 may be hydraulically fractured in stages. For example, a first stage may include hydraulically fracturing the perforations 190G, 190H to generate fractures 150G, 150H, respectively. After the hydraulic fracturing operations for the first stage are complete, a frac plug 130 may be positioned in the casing 106 above the first stage (i.e., at a lesser depth in the wellbore than perforations 190G, 190H). The frac plug 130 may be positioned in the wellbore 102 via any suitable setting method such as wireline 119. Similar operations may be repeated for each subsequent stage (i.e., setting frac plug 132 and frac plug 134 and hydraulically fracturing the next subsequent stage) until hydraulic fracturing operations for the wellbore 102 are complete.

Example Perforating Systems

Examples configurations of a perforating system are now described. The perforating systems are described in reference to the perforating gun 180 of FIG. 1.

Figure 2:
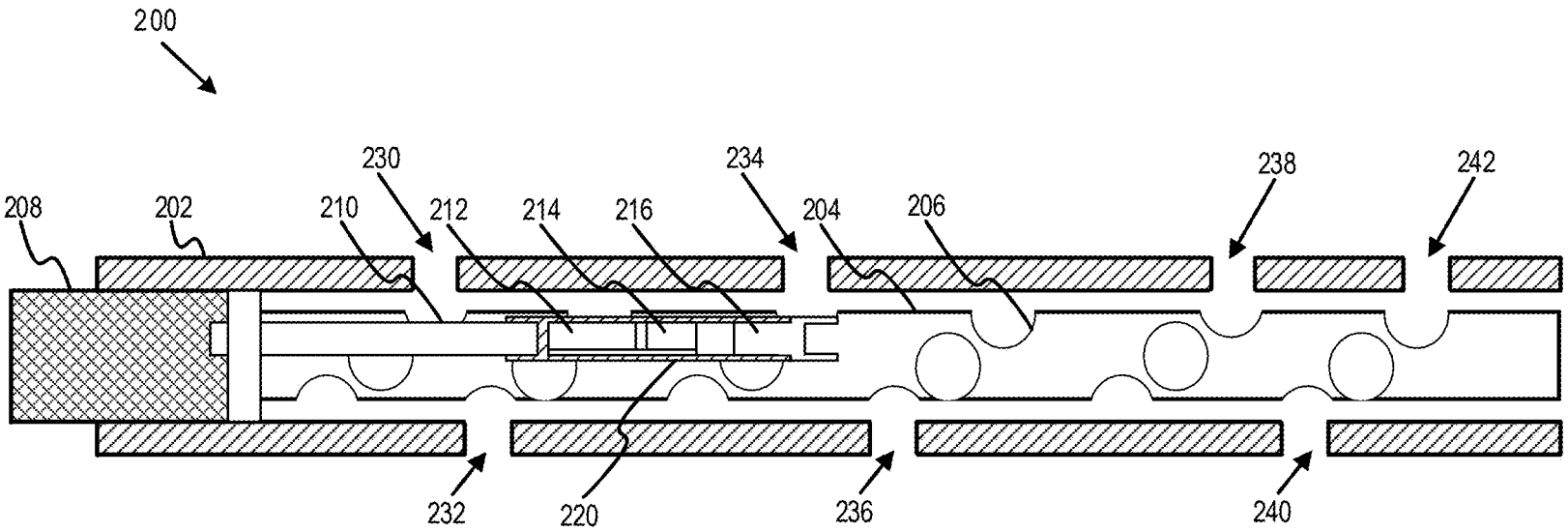
FIG. 2 is a schematic depicting an example perforating system, according to some implementations.

FIG. 2 is a schematic depicting an example perforating system, according to some implementations. In particular, FIG. 2 includes a partial cross sectional view of a perforating system 200. The perforating system 200 includes a carrier 202 and a tandem 208 that may couple the carrier to a wireline, coiled tubing, tubing string etc. In some implementations, the tandem 208 may couple the carrier 202 to another carrier and/or charge holding tube 204 to another charge holding tube A charge holding tube 204 may be positioned inside the inner bore of the carrier 202. The charge holding tube 204 may be configured with one or more holes, such as hole 206, to house shaped charges. The holes may be positioned at any suitable spacing and orientating on the charge holding tube 204. In some implementations, the carrier 202 may include one or more ports 230-242 which may be aligned with the shaped charges in the charge holding tube 204.

A communication conduit 210 may be positioned in the inner bore of the charge holding tube 204. In some implementations, the communication conduit 210 may be positioned between the charge holding tube 204 and the carrier 202 (such as coupled to the outside of the charge holding tube 204, the inner wall of the carrier 202, etc.). A sensor node 220 may be coupled to the distal end of the communication conduit 210. The length of the communication conduit 210 may be such that the sensor node 220 is positioned at a desired location in the charge holding tube 204. The sensor node 220 may include a power device 212 (such as one or more batteries) to supply power to a sensor 214. In some implementations, the sensor node 220 may include more than one sensor 214. The sensor 214 may obtain measurements such as pressure, temperature, fluid property measurements, etc. or any combination thereof of the wellbore before and/or after the shaped charges are detonated. The sensors node 220 may be configured such that the sensor 214 is exposed to the wellbore environment to obtain measurements while remaining contained inside the perforating system 200. For example, the sensor 214 may be exposed to the wellbore fluid via ports 230-242 such that it may obtain measurements such as pressure or other fluid property measurements. Alternatively, if the carrier 202 does not have ports, the sensor 214 may be exposed to the wellbore fluid after the shaped charges are detonated, allowing hydraulic communication between the inside of the carrier and wellbore annulus. In some implementations, the sensors may not need to be in hydraulic communication with the wellbore, such as if the sensors are to obtain temperature measurements.

The communication conduit 210 may include one or more cables, wires, etc. (such as an electrical conductor encased in an insulating jacket) to electrically couple the sensor 214 to communication devices and/or power sources. For example, the sensor 214 may be electrically coupled, via one or more wires in the communication conduit 210, to a communication device (not pictured) that may be configured to transmit the sensor data to the surface. Alternatively, or additionally, the sensor 214 may be electrically coupled to a wireline, via one or more wires in the communication conduit 210, to communicate the sensor data to the surface via the wireline. The communication conduit 210 may be coupled with a tandem 208 which may be coupled with the communication devices such as the wireline. In some implementations, the sensor(s) may be positioned on the tandem 208. In some implementations, the sensor 214 may be a memory sensor in which sensor data is stored on the sensor 214 and not communicated to the surface until the perforating system 200 is returned to the surface.

The communication conduit 210 may include a shield to protect from explosive blast from the shaped charges. The shield may provide a relatively hard barrier to shrapnel from the shaped charge explosions. The shield may be made of material that may provide adsorption of energy/moment transfer by deformation. The material may include composite or alloy of aluminum, chromium, nickel, copper, lead, silver, gold, tin, etc. Additionally, or alternatively, the shield may include impact absorbing materials such as Kevlar, polyurethane, silicone, rubber, aerogel, etc. In some implementations the shield may be layers of material. The use of layered or laminated material shields have been found to provide shock and energy dissipation of energy from explosive events. The alternating materials absorb shrapnel momentum and disrupt shockwaves that may damage the electronic communication paths of the sensors. The layers may include a combination of hard and soft layers. Example layered configurations may include hard-soft and soft-hard-soft layering.

In some implementations, the shield may form the communication conduit 210. For example, the shield may be shaped and positioned against the charge holding tube 204 such that a conduit may be formed between the shield and the wall of the charge holding tube 204 for communication wires to pass through. In some implementations, the shield may be positioned at least partially around the communication conduit 210. For example, the communication conduit 210 may comprise a tube. The shield may at least partially encase the tube. The shield may be any shape such as curved, cylindrical, gnomon, etc. The shield may also protect other components associated with the sensor and sensor communication, such as the sensor node 220. In some implementations, the shield may at least be a part of the sensor node 220. In some implementations, the sensor 214 may be positioned in its own sensor enclosure.

The sensor node 220 may include a connector 216 where additional communication conduits and sensor node subassemblies may be coupled, allowing multiple sensors to be positioned in the perforating system 200. For example, multiple sensors 214 may be positioned in the charge holding tube 204, sensors may be positioned in multiple charge holding tubes 204 within the carrier 202, etc. The connector 216 may be any suitable connector such a threaded connector, a bulkhead, etc., that may or may not be hydraulically sealed. The communication conduits 210 may have a length such that multiple sensors may be positioned at any desired length interval along the perforating system 200.

The additional sensors may also include a corresponding battery for power. In some implementations, the sensors in the perforating system 200 may be supplied power from a common battery/battery system. The additional sensors may be electrically coupled to its own communication cable(s), and/or electrically coupled to the communication cables associated with the proximate sensor to electrically couple the sensors to communication device(s) (such as the wireline to surface) such that sensor data may be communicated to the surface.

In some implementations, the perforating system 200 may include more than one carrier 202 and associated components (one or more charge holding tubes 204, sensor and communication conduit subassemblies, etc.). The carriers may be connected via a connector. The connector may include a threaded connection, sealed connection (such as a bulkhead), etc., or any combination thereof. In some implementations, sensors may be positioned in each of the carriers and electrically coupled via the connector.

Figure 3:
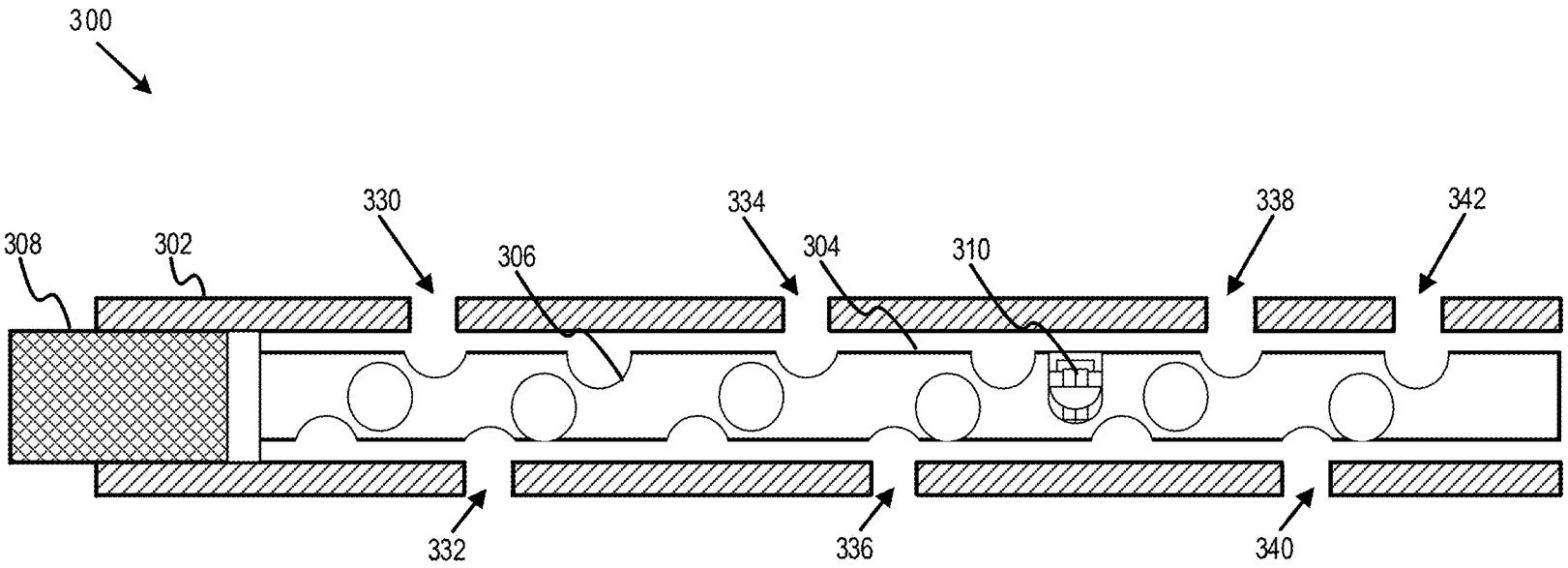
FIG. 3 is a schematic depicting an example perforating system, according to some implementations.

FIG. 3 is a schematic depicting an example perforating system, according to some implementations. In particular, FIG. 3 includes a partial cross sectional view of a perforating system 300. The perforating system 300 includes similar components as the perforating system 200 of FIG. 2. For example, the perforating system 300 includes a carrier 302 and a tandem 308 that may couple the carrier to a wireline, coiled tubing, etc. A charge holding tube 304 may be positioned inside the inner bore of the carrier 302. The charge holding tube 304 may be configured with one or more holes, such as hole 306, to house shaped charges. The holes may be positioned at any suitable spacing and orientating on the charge holding tube 304. In some implementations, the carrier 302 may include one or more ports 330-342 which may be aligned with the shaped charges in the charge holding tube 304.

In some implementations, one or more sensors may be positions in one of the holes of the charge holding tube 304, such as sensor 310. For example, a sensor enclosure may be positioned (e.g., threaded) into a hole of the charge holding tube 304. The sensor 310 and associated components (such as batteries) may be positioned in the sensor enclosure. The sensor 310 may be memory sensors or electrically coupled to one or more communication devices that may communicate the sensor data to the surface. For example, communication conduits (such as the communication conduit 210 of FIG. 2 and associated components such as a shield) may be coupled to the sensor in the hole of the charge holding tube 304 to electrically communicate the sensor to the communication device(s).

In some implementations, the sensor 310 and associated components (battery, sensor enclosure, etc.) may be positioned on the carrier, such as inserted (threaded) into the scallops of the carrier 302.

Figure 4A:
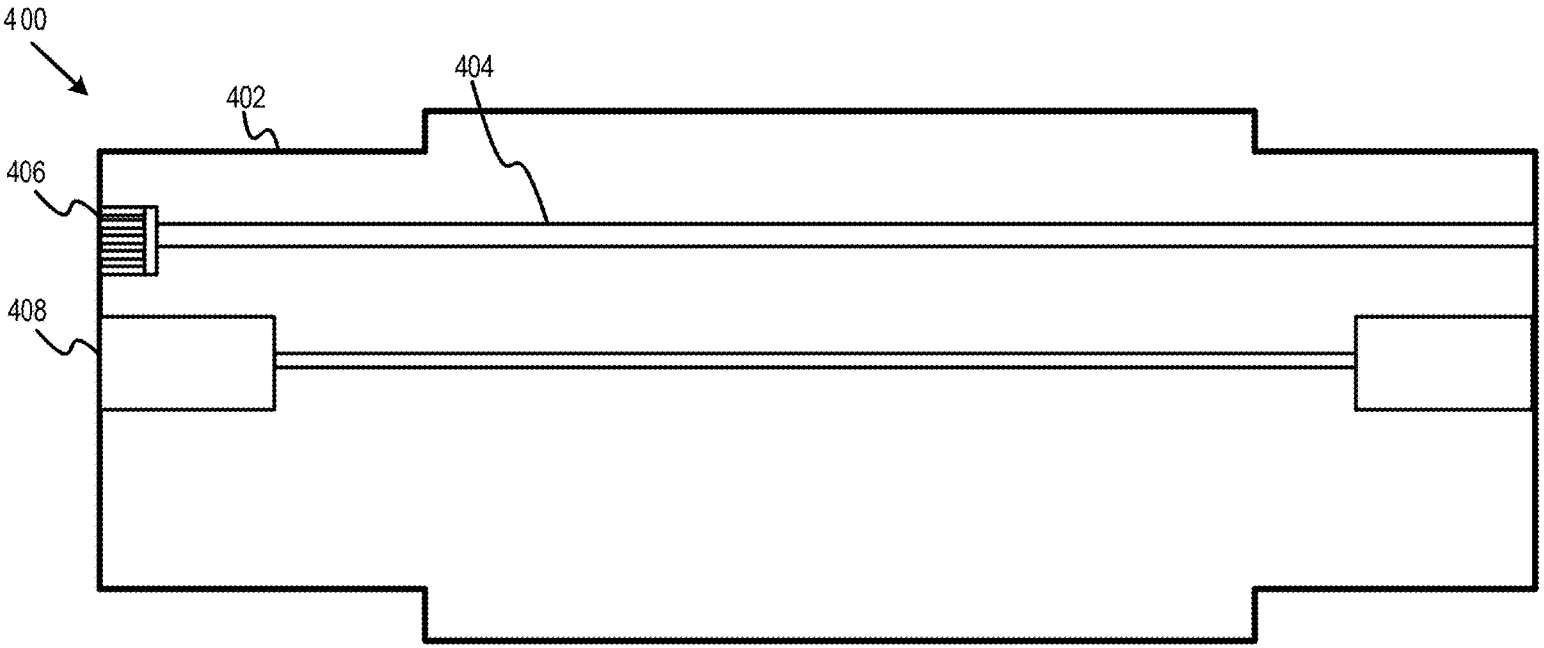
FIGS. 4A-4B are schematic depicting example perforating systems, according to some implementations.
Figure 4B:
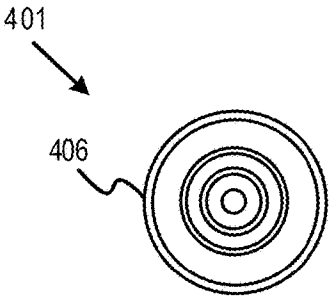

FIGS. 4A-4B are schematic depicting example perforating systems, according to some implementations. In particular, FIG. 4A includes a partial cross sectional view of a perforating system 400. The perforating system 400 includes a charge holding tube 402. A communication conduit 404 (similar to communication conduit 210 of FIG. 2) may be positioned within the charge holding tube 402. In some implementations, the communication conduit 404 may be positioned on the exterior of the charge holding tube 402. The communication conduit 404 may be configured with a conductive connector 406 configured with one or more paths to connect to other communication conduits, communication devices (such as devices to communicate the measurements back to surface), power sources, etc. A cross-sectional view of conductive connector 406 comprising multiple paths is depicted in FIG. 4B. The charge holding tube 402 may also include an explosive path 408 configured to detonate the shape charges not shown).

Figure 5A:
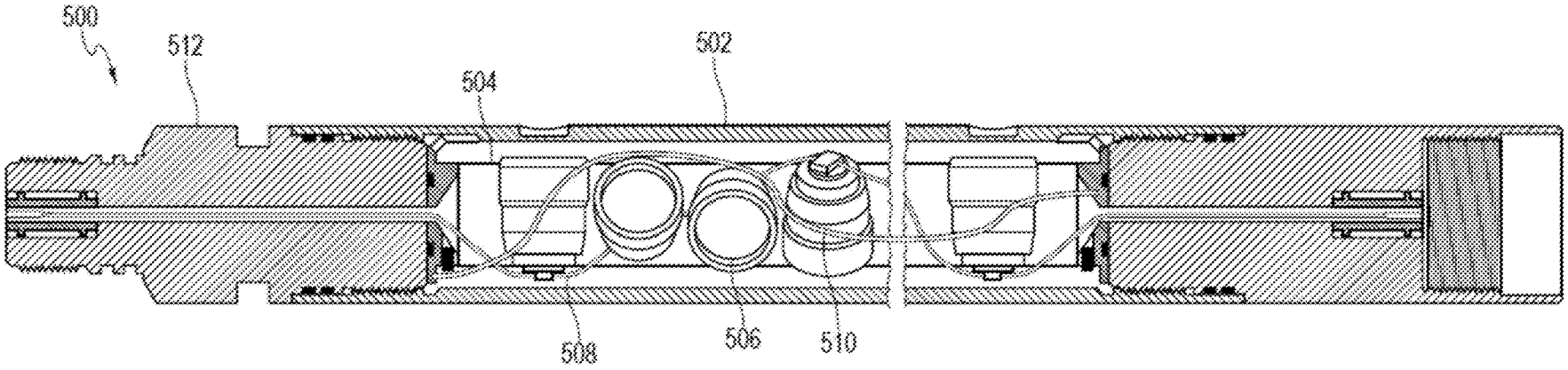
FIGS. 5A-5B are schematic depicting example perforating systems, according to some implementations.
Figure 5B:
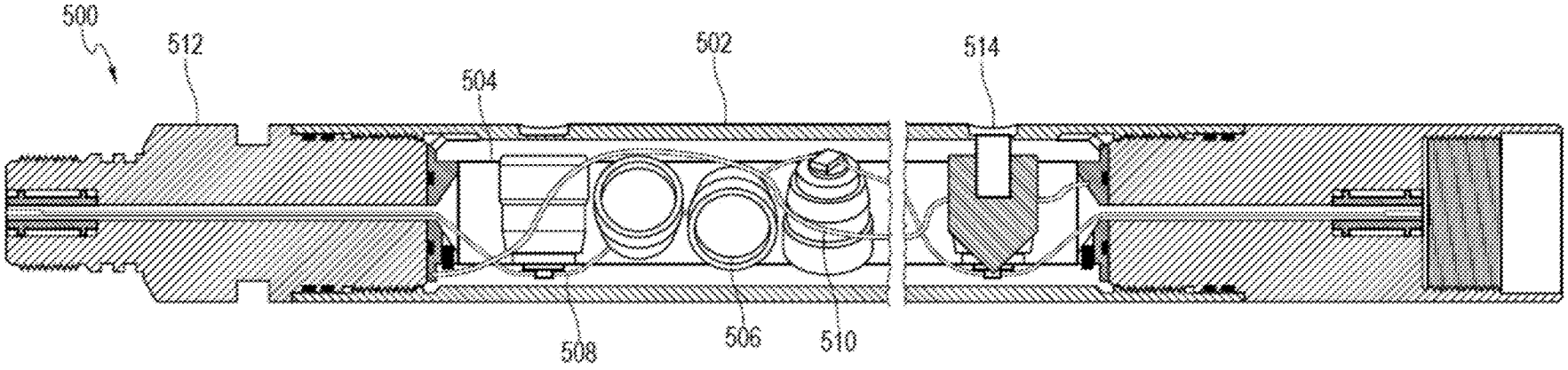

FIGS. 5A-5B are schematic depicting example perforating systems, according to some implementations. In particular, FIGS. 5A and 5B include partial cross sectional view of a perforating system 500 and perforating system 501, respectively. The perforating systems 500, 501 includes similar components as the perforating system 200 of FIG. 2. For example, the perforating systems 500, 501 includes a carrier 502 and a tandem 512 that may couple the carrier to a wireline, tubing, coiled tubing, etc., A charge holding tube 504 may be positioned inside the inner bore of the carrier 502. One or more shaped charges, such as shaped charge 506, may be positioned in the charge holding tube 504. An explosive path 508 may be coupled with each of the shaped charges to detonate each shaped charge. A communication conduit 510 may be positioned inside and/or outside the charge holding tube 504 and coupled with one or more sensors (such as sensor housing 514 comprising a sensor in place of a shaped charge in the charge holding tube 504, similar to the sensor 310 of FIG. 3, or any other sensors positioned in the carrier 502) as described in FIGS. 2 and 3.

Figure 6:
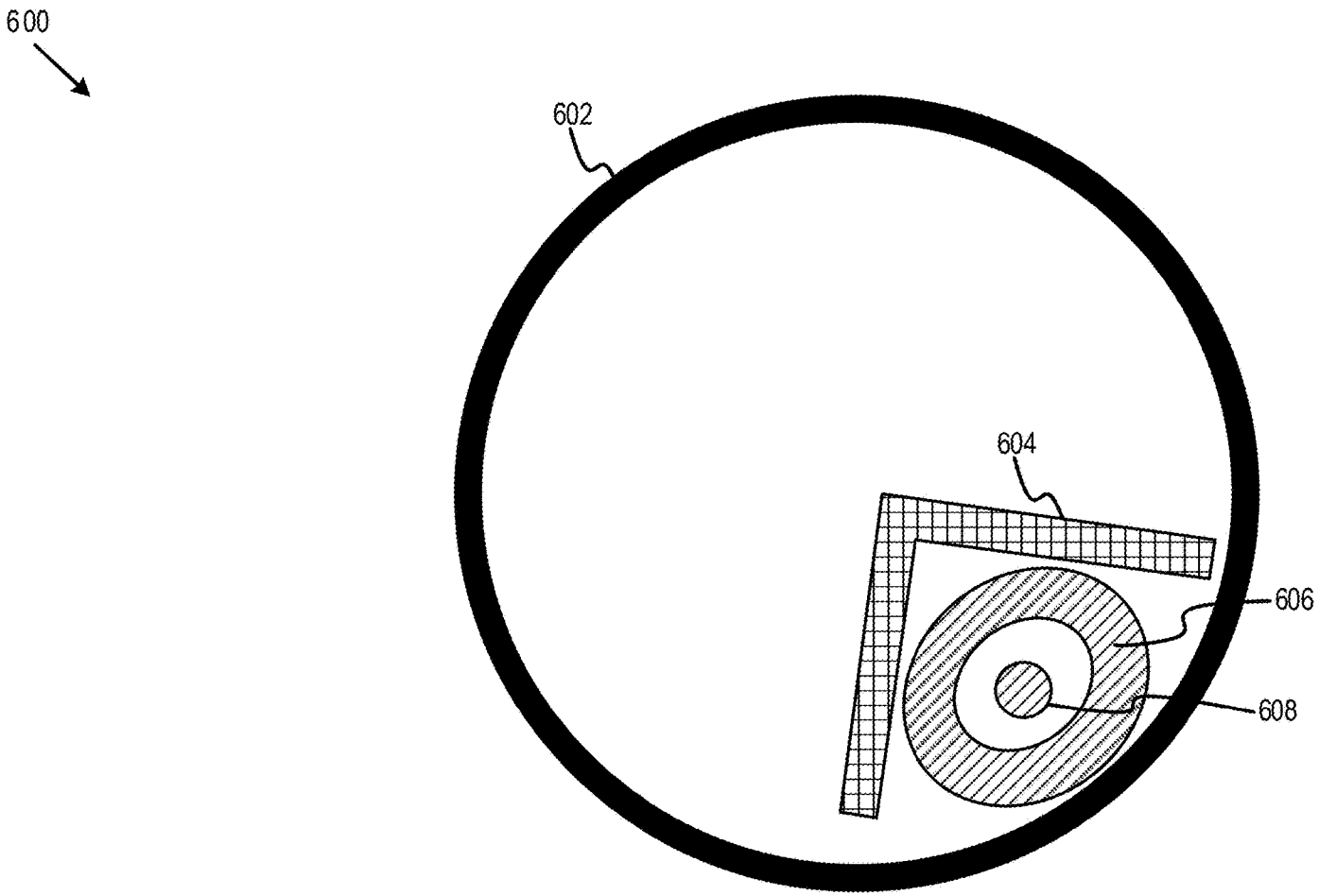
FIG. 6 is a schematic depicting a cross-sectional view of a perforating system, according to some implementations.

FIG. 6 is a schematic depicting a cross-sectional view of a perforating system, according to some implementations. In particular, FIG. 6 includes a cross-section of a perforating system 600. The perforating system includes a tube 602. The tube 602 may be representative of a carrier or a charge holding tube in a perforating system. A communication conduit for a communication path 608 (such as a wire) may be formed with an outer shield 604 and inner shield 606. The outer shield 604 may be any suitable shape and comprise one or more materials (as described above) to protect the communication path 608 from the explosive energy when the shaped charges are detonated. Similarly, the inner shield may at least partially encase the communication path 608 to proved protection from the shaped charges.

The perforation systems described in FIGS. 2-6, are examples of sensors positioned within a carrier to be integrated into the perforating systems, and are not limited to the positions within the carrier. Sensors may be positioned in any suitable location within the perforating systems. In some implementations, a plurality of sensors may be positioned in different locations within a perforating system. For example, one or more sensor may be positioned in the inner bore of a charge holding tube and one or more sensors may be positioned in respective holes of the charge holding tube. In some implementations, a combination of different sensors may be utilized in the perforating system. For example, one or more sensors may be coupled to a communication device and one or more sensors may be memory sensors.

Example Operations

Examples operations are now described.

Figure 7:
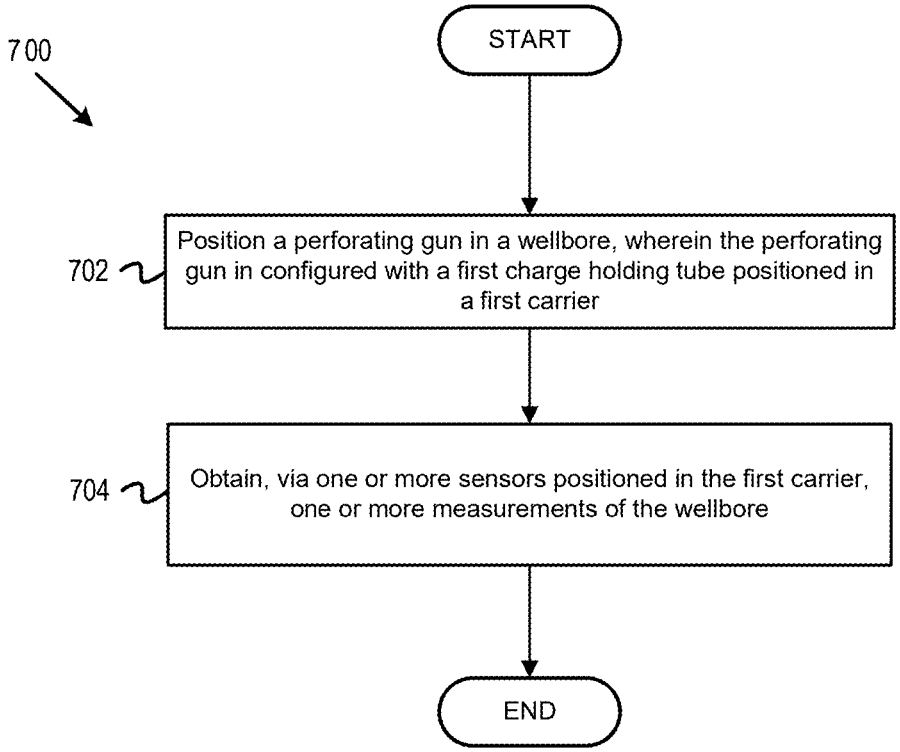
FIG. 7 is a flowchart depicting example operations for obtaining wellbore measurements, via one or more sensors housed in a perforating gun.

FIG. 7 is a flowchart depicting example operations for obtaining wellbore measurements, via one or more sensors housed in a perforating gun. FIG. 7 depicts a flowchart 700 of operations to position a perforating gun in a wellbore to perforate a portion of a wellbore and obtain measurements of the perforated zone. The operations of flowchart 700 are described in reference to the perforation systems 7 in FIGS. 2-6. Additionally, the operations of the flowchart 700 are described in reference to the processor of the computer 170 described in FIG. 1.

At block 702, a perforating gun may be positioned in a wellbore, wherein the perforating gun is configured with a first charge holding tube positioned in a first carrier.

At block 704, the processor of the computer 170 may obtain via one or more sensors positioned in the first carrier, one or more measurements of the wellbore. The measurements may be obtained before and/or after perforating a zone of the wellbore. The measurements may be communicated back to the surface via wireline, a wireless communication device, etc.

Example Computer

Figure 8:
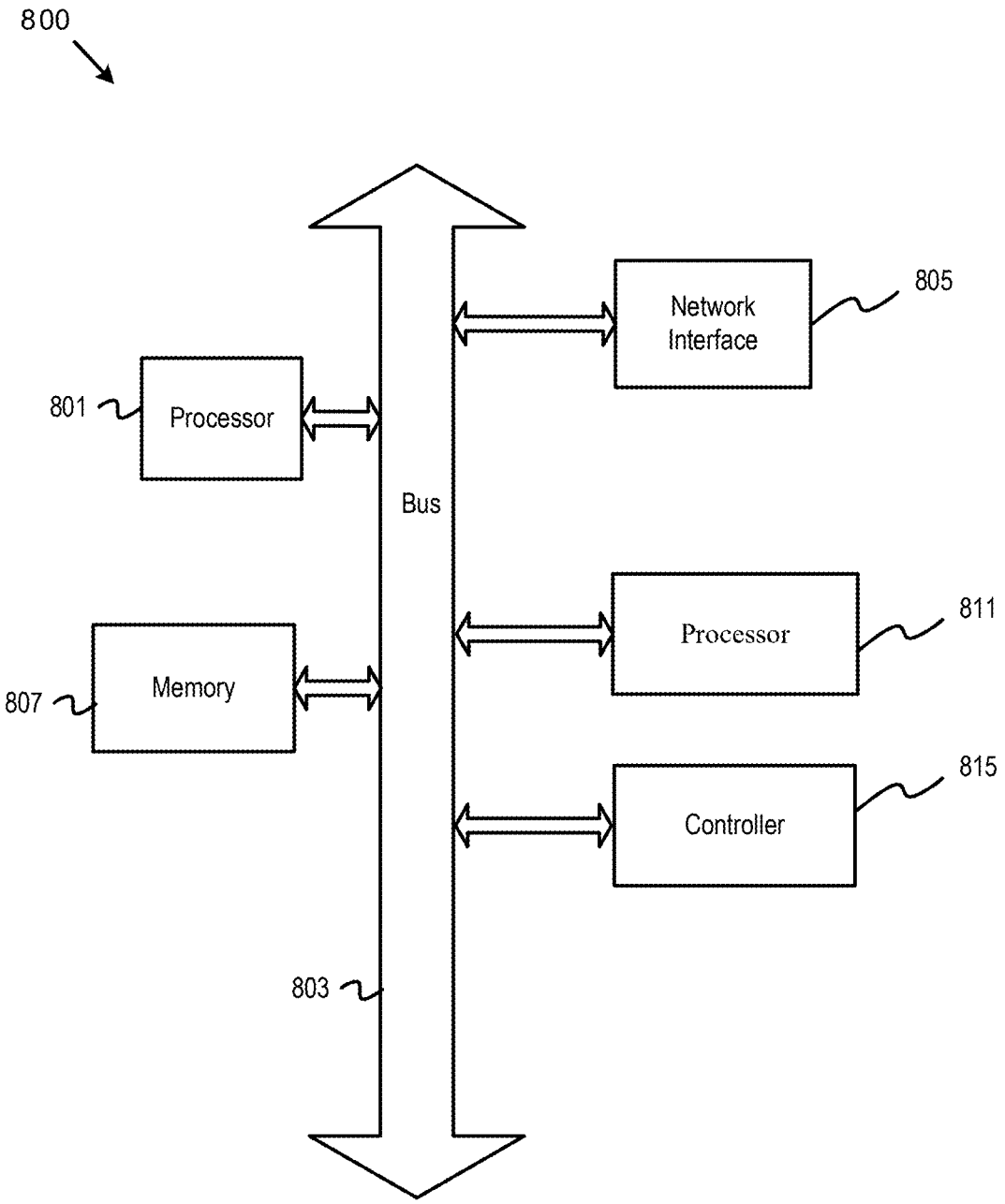
FIG. 8 is a block diagram depicting an example computer, according to some implementations.

FIG. 8 is a block diagram depicting an example computer, according to some implementations. FIG. 8 depicts a computer 800 for obtaining and processing measurements when perforating a wellbore. The computer 800 includes a processor 801 (possibly including multiple processors, multiple cores, multiple nodes, and/or implementing multi-threading, etc.). The computer 800 includes memory 807. The memory 807 may be system memory or any one or more of the above already described possible realizations of machine-readable media. The computer 800 also includes a bus 803 and a network interface 805. The computer 800 can communicate via transmissions to and/or from remote devices via the network interface 805 in accordance with a network protocol corresponding to the type of network interface, whether wired or wireless and depending upon the carrying medium. In addition, a communication or transmission can involve other layers of a communication protocol and or communication protocol suites (e.g., transmission control protocol, Internet Protocol, user datagram protocol, virtual private network protocols, etc.).

The computer 800 also includes a processor 811 and a controller 815 which may perform the operations described herein. For example, the processor 811 may store and process sensor data, such as measurements of a wellbore, obtained from one or more sensors positioned in a perforating system. The controller 815 may execute one or more action, such as obtaining sensor data, detonating one or more shaped charges in a perforating system, etc. The processor 811 and the controller 815 can be in communication. Any one of the previously described functionalities may be partially (or entirely) implemented in hardware and/or on the processor 801. For example, the functionality may be implemented with an application specific integrated circuit, in logic implemented in the processor 801, in a co-processor on a peripheral device or card, etc. Further, realizations may include fewer or additional components not illustrated in FIG. 8 (e.g., video cards, audio cards, additional network interfaces, peripheral devices, etc.). The processor 801 and the network interface 805 are coupled to the bus 803. Although illustrated as being coupled to the bus 803, the memory 807 may be coupled to the processor 801.

While the aspects of the disclosure are described with reference to various implementations and exploitations, it will be understood that these aspects are illustrative and that the scope of the claims is not limited to them. In general, techniques for obtaining measurements of one or more sensors positioned in a perforating system described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable subcombination. Moreover, although features may be described as acting in certain combinations and even initially claimed as such, one or more features from a claimed combination may in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations. In certain circumstances, multitasking and parallel processing may be advantageous. Moreover, the separation of various system components in the implementations described should not be understood as requiring such separation in all implementations, and the described program components and systems may generally be integrated together in a single software product or packaged into multiple software products. Additionally, other implementations are within the scope of the following claims. In some cases, the actions recited in the claims may be performed in a different order and still achieve desirable results.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subsurface formation" shall be construed as encompassing both areas below exposed earth and areas below earth covered by water such as ocean or fresh water.

Example Implementations

Implementation #1: A perforating system comprising: a first carrier; a first charge holding tube configured with one or more shaped charges, wherein the first charge holding tube is positioned within the first carrier; and one or more sensors positioned within the first carrier and configured to obtain one or more measurements of a perforated zone in a wellbore.

Implementation #2: The perforating system of Implementation #1 further comprising: a first communication conduit positioned inside the first carrier and configured to electrically couple a first sensor of the one or more sensors to at least one of a communication device or a power source, wherein one or more cables, wires, or any combination thereof are positioned in the first communication conduit.

Implementation #3: The perforating system of Implementation #2, wherein the first communication conduit comprises a tube that is at least partially encased by a shield, wherein the shield comprises at least one of aluminum, chromium, nickel, copper, lead, silver, gold, tin, Kevlar, polyurethane, silicon, rubber, or aerogel.

Implementation #4: The perforating system of Implementation #2 or 3, wherein a shield is positioned against a wall of the first carrier or a wall of the first charge holding tube and is shaped to form the first communication conduit, wherein the shield is in a shape including curved, cylindrical, or gnomon.

Implementation #5: The perforating system of any one or more of Implementation #2-4 further comprising: a second communication conduit positioned inside the first carrier and configured to electrically couple a second sensor of the one or more sensors to at least one of the communication device or the power source, wherein the first communication conduit is coupled with the second communication conduit.

Implementation #6: The perforating system of any one or more of Implementation #2-5 further comprising: a second communication conduit positioned inside a second carrier and configured to electrically couple a second sensor to at least one of the communication device or the power source, wherein the first communication conduit is coupled with the second communication conduit via a connector between the first carrier and the second carrier.

Implementation #7: The perforating system of any one or more of Implementation #1-6, wherein the one or more sensors are positioned in respective holes of the first charge holding tube, respective scallops of the first carrier, or any combination thereof.

Implementation #8: The perforating system of any one or more of Implementation #1-7, wherein the one or more sensors are positioned between the first carrier and the first charge holding tube, in an inner bore of the first charge holding tube, or any combination thereof.

Implementation #9: The perforating system of any one or more of Implementation #1-8, wherein the one or more measurements includes pressure, temperature, or any combination thereof.

Implementation #10: An apparatus comprising: one or more sensors positioned within a first carrier and configured to obtain one or more measurements of a perforated zone in a wellbore, wherein a first charge holding tube is positioned within the first carrier and configured with one or more shaped charges.

Implementation #11: The apparatus of Implementation #10 further comprising: a first communication conduit positioned inside the first carrier and configured to electrically couple a first sensor of the one or more sensors to at least one of a communication device or a power source, wherein one or more cables, wires, or any combination thereof are positioned in the first communication conduit.

Implementation #12: The apparatus of Implementation #11, wherein the first communication conduit comprises a tube that is at least partially encased by a shield, wherein the shield comprises at least one of aluminum, chromium, nickel, copper, lead, silver, gold, tin, Kevlar, polyurethane, silicon, rubber, or aerogel.

Implementation #13: The apparatus of Implementation #11 or 12, wherein a shield is positioned against a wall of the first carrier or the first charge holding tube and is shaped to form the first communication conduit, wherein the shield is in a shape including curved, cylindrical, or gnomon.

Implementation #14: The apparatus of any one or more of Implementation #11-13 further comprising: a second communication conduit positioned inside the first carrier and configured to electrically couple a second sensor of the one or more sensors to at least one of the communication device or the power source via, wherein the first communication conduit is coupled with the second communication conduit.

Implementation #15: The apparatus of any one or more of Implementation #10-14, wherein the one or more sensors are positioned in respective holes of the first charge holding tube, respective scallops of the first carrier, or any combination thereof.

Implementation #16: The apparatus of any one or more of Implementation #10-15, wherein the one or more sensors are positioned between the first carrier and the first charge holding tube, in an inner bore of the first charge holding tube, or any combination thereof.

Implementation #17: The apparatus of any one or more of Implementation #10-16, wherein the one or more measurements includes pressure, temperature, or any combination thereof.

Implementation #18: A method comprising: positioning a perforating gun in a wellbore, wherein the perforating gun in configured with a first charge holding tube positioned in a first carrier; obtaining, via one or more sensors positioned in the first carrier, one or more measurements of the wellbore.

Implementation #19: The method of Implementation #18, wherein the one or more measurements are obtained before or after perforating a zone of the wellbore.

Implementation #20: The method of Implementation #18 or 19 further comprising: communicating the one or more measurements to surface, wherein the one or more measurements are communicated via wireline or a wireless communication device.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B. C} or any combination thereof, including multiples of any element.

The invention claimed is:

1. A perforating system comprising:

a first carrier;

a first charge holding tube configured with one or more shaped charges, wherein the first charge holding tube is positioned within the first carrier; and one or more sensors configured to obtain one or more measurements of a perforated zone in a wellbore, wherein the one or more sensors are positioned between the first carrier and the first charge holding tube, in an inner bore of the first charge holding tube, or any combination thereof.

2. The perforating system of claim 1 further comprising:

a first communication conduit positioned inside the first carrier and configured to electrically couple a first sensor of the one or more sensors to at least one of a communication device or a power source, wherein one or more cables, wires, or any combination thereof are positioned in the first communication conduit.

3. The perforating system of claim 2, wherein the first communication conduit comprises a tube that is at least partially encased by a shield, wherein the shield comprises at least one of aluminum, chromium, nickel, copper, lead, silver, gold, tin, Kevlar, polyurethane, silicon, rubber, or aerogel.

4. The perforating system of claim 2, wherein a shield is positioned against a wall of the first carrier or a wall of the first charge holding tube and is shaped to form the first communication conduit, wherein the shield is in a shape including curved, cylindrical, or gnomon.

5. The perforating system of claim 2 further comprising:

a second communication conduit positioned inside the first carrier and configured to electrically couple a second sensor of the one or more sensors to at least one of the communication device or the power source, wherein the first communication conduit is coupled with the second communication conduit.

6. The perforating system of claim 2 further comprising:

a second communication conduit positioned inside a second carrier and configured to electrically couple a second sensor to at least one of the communication device or the power source, wherein the first communication conduit is coupled with the second communication conduit via a connector between the first carrier and the second carrier.

7. The perforating system of claim 1, wherein the one or more sensors are positioned in respective holes of the first charge holding tube, respective scallops of the first carrier, or any combination thereof.

8. The perforating system of claim 1, wherein the one or more measurements includes pressure, temperature, or any combination thereof.

9. An apparatus comprising:

one or more sensors configured to obtain one or more measurements of a perforated zone in a wellbore, wherein a first charge holding tube is positioned within a first carrier and configured with one or more shaped charges, and wherein the one or more sensors are positioned between the first carrier and the first charge holding tube, in an inner bore of the first charge holding tube, or any combination thereof.

10. The apparatus of claim 9 further comprising:

a first communication conduit positioned inside the first carrier and configured to electrically couple a first sensor of the one or more sensors to at least one of a communication device or a power source, wherein one or more cables, wires, or any combination thereof are positioned in the first communication conduit.

11. The apparatus of claim 10, wherein the first communication conduit comprises a tube that is at least partially encased by a shield, wherein the shield comprises at least one of aluminum, chromium, nickel, copper, lead, silver, gold, tin, Kevlar, polyurethane, silicon, rubber, or aerogel.

12. The apparatus of claim 10, wherein a shield is positioned against a wall of the first carrier or the first charge holding tube and is shaped to form the first communication conduit, wherein the shield is in a shape including curved, cylindrical, or gnomon.

13. The apparatus of claim 10 further comprising:

a second communication conduit positioned inside the first carrier and configured to electrically couple a second sensor of the one or more sensors to at least one of the communication device or the power source via, wherein the first communication conduit is coupled with the second communication conduit.

14. The apparatus of claim 9, wherein the one or more sensors are positioned in respective holes of the first charge holding tube, respective scallops of the first carrier, or any combination thereof.

15. The apparatus of claim 9, wherein the one or more measurements includes pressure, temperature, or any combination thereof.

16. A method comprising:

positioning a perforating gun in a wellbore, wherein the perforating gun is configured with a first charge holding tube positioned in a first carrier;

obtaining, via one or more sensors, one or more measurements of the wellbore, wherein the one or more sensors are positioned between the first carrier and the first charge holding tube, in an inner bore of the first charge holding tube, or any combination thereof.

17. The method of claim 16, wherein the one or more measurements are obtained before or after perforating a zone of the wellbore.

18. The method of claim 16 further comprising:

communicating the one or more measurements to surface, wherein the one or more measurements are communicated via wireline or a wireless communication device.

* * * * *